US005199341A

United States Patent [19]

Jones

[11] Patent Number: 5,199,341

[45] Date of Patent: Apr. 6, 1993

[54] IN-LINE, ADJUSTABLE GAP CUTTING SHEETER FOR PRINTED WEBS

[75] Inventor: Donald A. Jones, Terre Haute, Ind.

[73] Assignee: Numerical Concepts, Inc., Terre Haute, Ind.

[21] Appl. No.: 870,394

[22] Filed: Apr. 17, 1992

Related U.S. Application Data

[63] Continuation-in-part of Ser. No. 521,570, May 10, 1990.

[51] Int. Cl.[5] ..... B26D 7/18

[52] U.S. Cl. ..... 83/100; 83/110; 83/117; 83/303; 83/349; 83/403.1; 83/934

[58] Field of Search ..... 83/98, 100, 934, 110, 83/403.1, 169, 303, 331, 349, 117; 493/361, 362; 271/202, 265, 270

[56] References Cited

U.S. PATENT DOCUMENTS

| | | | |
|---|---|---|---|
| 4,387,614 | 6/1983 | Evans | 83/303 X |
| 4,397,204 | 8/1983 | Colombo | 83/303 X |
| 4,486,516 | 11/1984 | Leroy | 83/98 |

*Primary Examiner*—Frank T. Yost
*Assistant Examiner*—Kenneth E. Peterson
*Attorney, Agent, or Firm*—H. John Barnett

[57] ABSTRACT

A gap cutting sheeter having controls to adjust the cutting position of the first and second flying shears relative to each other to set the gap size to a particular printed sheet. The downstream flying shear can be set up to cut the leading edge or the following edge of while the web is moving. When cutting the leading edge, a flexible flipper is provided just ahead of the flying shear to contact and push successive cut chips toward a vacuum chip removal system. Alternating vacuum removes the chips, and pulsing positive air pressure against the underside of a leading, trimmed edge guides it over the chip removal vacuum chamber to the downstream conveyor. A knockdown vane is provided just after the flying shear to press the leading edge of a cut signature against the downstream deck plate to prevent wrinkling of the cut signatures. Simple and rapid gap size adjustment is accomplished by electronically controlling the relative positions and speed of the first and second flying shears, the speed of the incoming web relative to the downstream speed of the cut signatures and the synchronized control of the high pressure fed vacuum chip removal system. In either embodiment, the important feature of the invention is the simple and rapid gap size adjustment which is made possible by electronically controlling and mechanically phasing the relative positions and speed of the first and second flying shears, the speed of the incoming web relative to the downstream speed of the cut sheets or signatures and the synchronized control of the high pressure fed, vacuum chip removal system.

15 Claims, 8 Drawing Sheets

IN-LINE, ADJUSTABLE GAP CUTTING SHEETER FOR PRINTED WEBS

This is a continuation-in-part of copending application Ser. No. 07/521,570 filed on May 10, 1990.

BACKGROUND OF THE INVENTION

This invention relates to a high-speed, infinitely adjustable gap cutting sheeter for printed webs or signatures which employs a dual rotary knife system in combination with a synchronized, variable high pressure transient or pulsating air flow in combination with a vacuum chip remover which does not interfere with the continuous flow of the passing sheets or signatures. The rotary knives are two separate assemblies, one synchronized with the other and both synchronized to the passing printed web tracking a pre-printed mark on the printed web. The second knife can be changed in position relative to the first knife so that gap size can be changed instantaneously without any downtime between printing runs having different gap cutting requirements.

DESCRIPTION OF THE RELATED ART

The following patents relate to prior systems for trimming sheet material:

| Patent Number | Inventor/Assignee | Date |
|---|---|---|
| 3,811,350 | Marciniak | 1974 |
| 4,103,595 | Corse | 1978 |
| 4,387,614 | Evans | 1983 |
| 4,397,204 | Colombo | 1983 |
| 4,409,870 | Rynik et al | 1983 |
| 4,452,114 | Rynik et al | 1984 |
| 4,480,516 | Leroy | 1984 |
| 4,566,360 | Lehmann | 1986 |
| 4,594,923 | Fujita | 1986 |
| 4,599,926 | Carlson et al | 1986 |
| 4,650,453 | Bildung et al | 1987 |
| 4,704,930 | Bödewein | 1987 |

Marciniak's patent describes an apparatus for trimming sheet material which includes a face knife at a first trimming station and head and tail or foot knives at a second trimming station spaced downstream therefrom. The sheet material is positively gripped by two parallel sets of positively driven conveyor belts. The sheet is gripped by the belts and the face edge portion trimmed by the face knife. An intermittent drive then cycles to move the partially trimmed sheet to the second trimming station as an uncut sheet is conveyed to the first trimming station. All three of the trim knives are then cycled simultaneously. Gap is adjusted by adjusting the distance between the head and foot trim knives (see Col 8 of patent). There is no showing of flyknives here.

Corse shows a flat cutting machine in combination with a rotary peeling apparatus or an interchangeable, rotary cutting machine. The peeling apparatus removes the scrap from the cut shapes. The rotary cutting machine replaces the peeling apparatus for long runs, and it removes the scrap which is evacuated through the chute 26 disposed adjacent rotary cutting machine 3.

Evans U.S. Pat. No. 4,387,614 is directed to automated "crop" cutting of corrugated paperboard when an order change or a roll-to-roll change is made within an order. The "crop" cutting is only necessary at these times, and disposal of the scrap or corrugated paperboard is apparently by gravity with no vacuum assist.

Colombo U.S. Pat. No. 4,397,204 describes cutting wood veneers with a main edged blade for cutting in lengths equal to the arc between two successive cutting edges. An auxiliary edged blade is provided downstream from the main edged blade to "crop" out defective parts of the wood veneer in response to electronic controls. An inclinable discarding conveyor belt is provided between the main and auxiliary edged blades to divert the defective wood strips from the downstream flow of cut wood veneer sheets. The "crop" cutting is only done as necessary to remove defective wood veneer, and is not cyclical. The diversion of the veneer scraps has no vacuum assist.

The two Rynik et al patents are identical, except for the claims. They describe a rotatable driven cutting cylinder which carries two or more pairs of spaced cutting knives which can be adjusted to cut trim strips down to 1/16" in width. The rational speed of the knives is greater than the speed of the web to reduce any bubbling of the web. The trim strips are removed through the space between the knives and the cylinder bore by air flow caused by a low pressure source connected to the cylinder bore. It appears to be necessary to reset the gap between the knife blades on the cutting cylinder in order to adjust the gap size.

Leroy U.S. Pat. No. 4,480,516 describes a machine for cutting round-ended sanitary towels in which the "off-cut" wastage is pulled by suction means onto a counter-roll. The "off-cut" is cut from the following edge of the towel after the leading edge of the towel is held by the downstream conveyor. Since the "off-cut" is taken from the following edge of the towel, there is no major need for a air-pulse system since the towel is already being held by the downstream conveyor when the "off-cut" is removed, and the next towel has not yet come into the gap at the cutting knife between the upstream and downstream conveyors. The vacuum is off when the partially cut, next successive towel traverses the gap.

Lehmann's patent describes a cutting device which includes at least one rotating cutter and one conveyor. To insure quality cuts of folded or unfolded sheets or booklets, the web material is clamped firmly by means of an elongated, spring-charged plate which presses against a flexible endless band or chain which presses and holds the web material against the endless belt conveyor. Lehmann does not appear to relate to gap cutting.

The Fujita patent describes a machine for manufacturing corrugated cardboard sheets which includes a controller for setting the length of sheet by sensing the cutting action of a rotary cutter, and by means of a formula for calculating a delay time starts a shear which cuts the sheet into a length determined by the formula. It does not appear to relate to gap cutting of a printed web, but to removing inferior cardboard sheet material.

Carlson et al describe rotary cutting dies having a vacuum assist to cut and clear waste after cutting labels, tags or tickets and the like. The scraps are sucked into the rotary cutting die, and transported through an axial passage therein to a waste collection point. The dies are secured to the die-cutting rolls, and require downtime to change.

Bildung et al describe apparatus for cross cutting a running web of paper, metallic foil, or plastic foil. The apparatus includes a pair of holders which attract the web by means of suction immediately behind the severing plane when the cutter severs the web. The holders advance with the freshly cut section to stabilize the travel direction of the cut sections to the removing station. A jet of compressed air can be used to separate the cut sections from the holders at the removing station. There is no disclosure of gap cutting a printed web.

U.S. Pat. No. 4,704,930 describes a vacuum system for removing edge strips trimmed from a moving web by a double longitudinal cutter. The vacuum system inlets are disposed between the two advancing webs and the edge strips are guided inwards over the lower cutters and removed. This patent does not describe gap cutting.

SUMMARY OF THE INVENTION

This invention is directed to a combination of inline first and second flying shears in a gap cutting sheeter having adjustable control means to adjust the cutting position of the first and second shears relative to each other to adjust the gap size to a particular printed sheet or signature. In one embodiment, the downstream flying shear cuts the leading edge of a sheet while the web sheet or signature is moving. The chip removal system provides alternating vacuum to remove the chips, and pulsing positive air pressure against the underside of a leading, trimmed edge to support and guide it over the chip removal vacuum chamber to the downstream conveyor. In another embodiment, the downstream flying shear is arranged to cut the following edge of a sheet or signature. In either embodiment, the important feature of the invention is the simple and rapid gap size adjustment which is made possible by electronically controlling or mechanically phasing the relative positions of the first and second flying shears, the speed of the incoming web relative to the downstream speed of the cut sheets or signatures and the synchronized control and phasing of the high pressure air directed to the vacuum chip removal system.

DETAILED DESCRIPTION OF THE INVENTION

Figure 1:
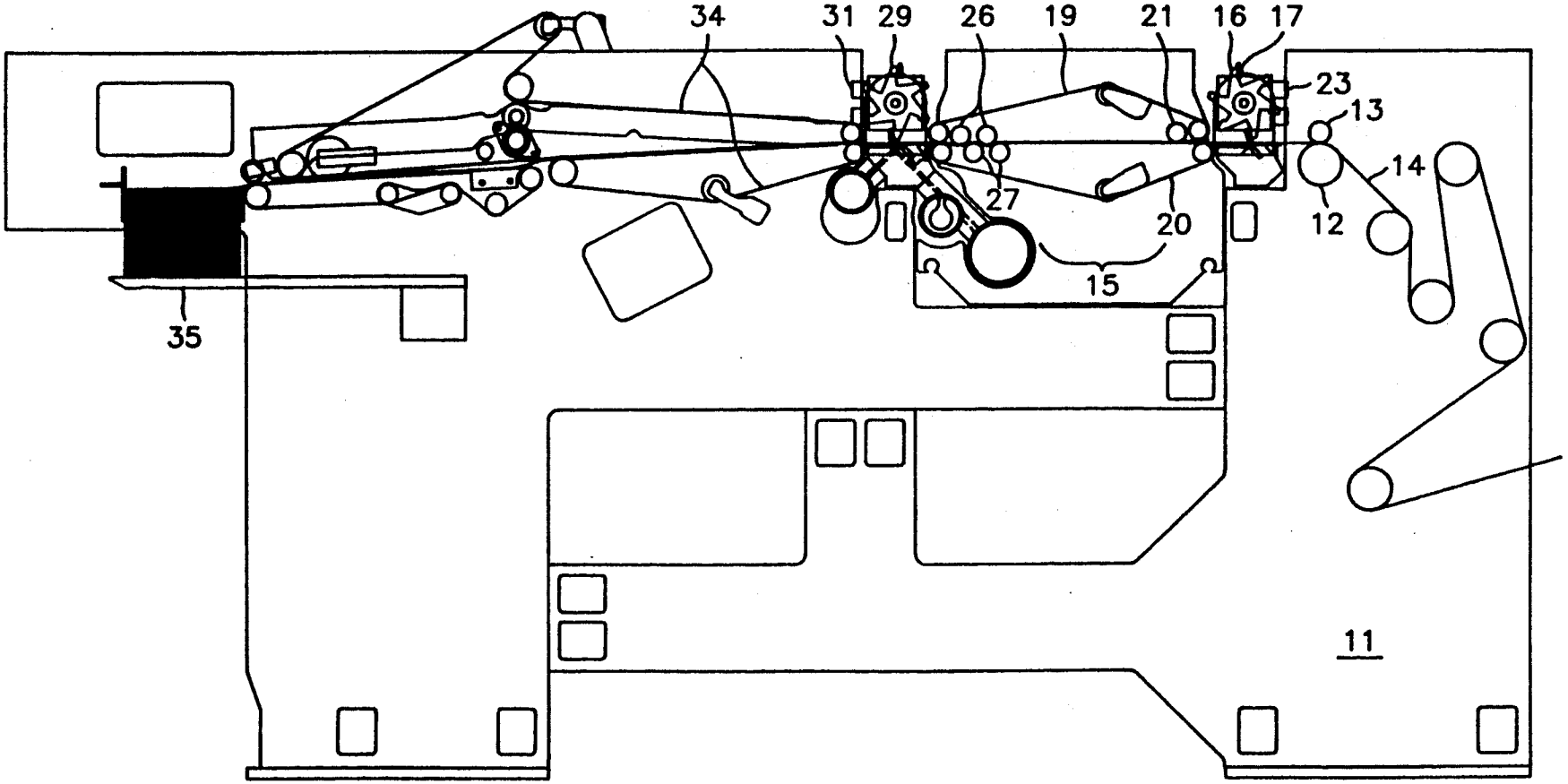
FIG. 1 is a schematic side elevation of the invention with some parts omitted to show the overall arrangement of the in-line, continuous sheet or signature gap cutting apparatus of the invention.
Figure 2:
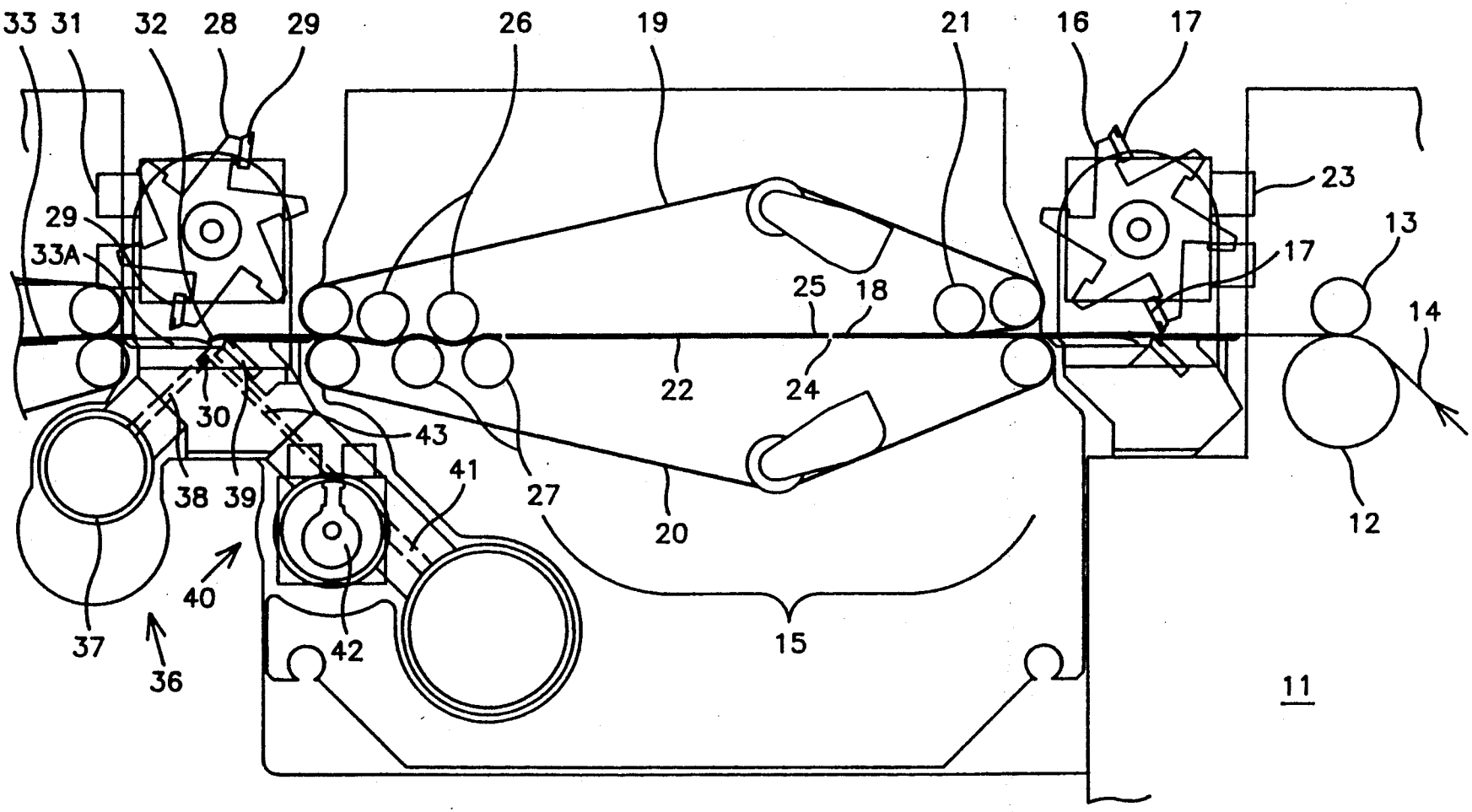
FIG. 2 side is an enlarged schematic side elevation of the gap cutting apparatus showing the coordinated action of the two cutting heads.

An in-line, adjustable gap cutting apparatus for printed webs with vacuum chip removal system and downstream delivery is shown schematically in FIG. 2. The apparatus is supported on a suitable frame 11 in a manner well-known to those skilled in the art. Draw roll 12, in cooperation with nip roll 13, draws a continuous web 14 into the accelerating conveyor belt system 15 which is operated at a speed higher than the speed of the incoming web 14.

The web 14 passes under an upstream rotary cutting head 16 which supports a first rotary knife 17. Cutting head 16 rotates clockwise as viewed in FIG. 2 to move first rotary knife 17 downwardly to shear web 14 at its leading edge 18 towards the downstream end of the gap cutting apparatus.

The conveyor belt system 15 includes upper belts 19 and lower belts 20, and an adjustable pinch roller 21 which is operated to insure that belts 19 and 20 are pulling on the web 14 while the rotary knife 17 cuts a sheet or signature 22 from the lead edge of the web 14.

The upstream rotary cutting head 16 carrying the rotary knife 17 is driven by a variable speed electric motor 23 which is electronically controlled to synchronize the position of the first rotary knife 17 to make a cut on a printed mark on the web 14 without aid from other cut-off controls. The printed mark (not shown) is determined by the space between printed sections of the web 14.

After the cut is made, the sheet or signature 22 being held by the upper belts 19 and the lower belts 20 accelerates to generate a space 24 between the trailing edge 25 of sheet or signature 22 and the leading edge 18 of the incoming web 14. The acceleration is caused by the slightly higher speed of conveyor belt system 15, and can be adjusted as desired to obtain a desired space 24 between trailing edge 25 and leading edge 18.

The sheet or signature 22 is next fed into a series of adjustable corrugation rollers 26 which push the upper belts 19 down against the sheet or signature 22 and the lower belts 20 and between lower stationary rollers 27 to hold the sheet or signature 22 firmly for the second cut at the downstream rotary cutting head 28. The cutting head 28 carries a second rotary knife 29 similar to the first rotary knife 17. Rotary knife 29 is also disposed to move downwardly towards the leading edge of the sheet or signature 22 to cut and remove chip 30 therefrom while the corrugation rollers 26 cooperate with lower stationary rollers 27 to hold the sheet or signature 22 firmly during the cutting action.

The downstream rotary cutting head 28 carrying the second rotary knife 29 is driven by a second variable speed electric motor 31 like the motor 23 so that the position of the second rotary knife 29 can be synchronized and controlled to remove a chip 30 of predetermined size. The second rotary knife 29 is phased with the first rotary knife 17, the overspeed of the conveyor belt system 15, and the positioning of the adjustable corrugating rollers 26 to closely control the size of the chip 30 taken off the leading edge 32 of the sheet or signature 22 to produce a finished sheet or signature 33.

Finished sheet or signature 33 then is conveyed on downstream into downstream conveyor belt system 34, where the finished sheets or signatures 33 are stacked in stacking system 35 which will not be further described here. It may be a continuous, in-line stacker of the type described in Co-Pending U.S. Pat. No. 5,014,974 issued May 14, 1991 to D. A. Jones, et al.

Important to the successful high speed operation of the continuous gap cutting sheeter of the subject invention is the chip removal system. The synchronized high pressure fed vacuum chip removal system 36 includes a vacuum tube 37 which has a transverse slot 38 just below stationary blade 39 which cooperates with the second rotary knife 29 to remove chip 30 from the leading edge 32 of sheet or signature 22.

Also included in the chip removal system 36 is pulsating, high pressure air system 40, which includes a plurality of air passages 41 which connect to a rotary air valve 42. A second set of air passages 43 connect the high pressure air system to the transverse slot 38 of the vacuum tube 37 so that pulses of high pressure air can be supplied to the transverse slot 38 to effectively cancel the vacuum of the chip removal system 36 and allow the leading edge 32 of the finished sheet or signature 33 to pass over the chip removal system 36 and into the downstream conveyor belt system 34.

Figure 3:
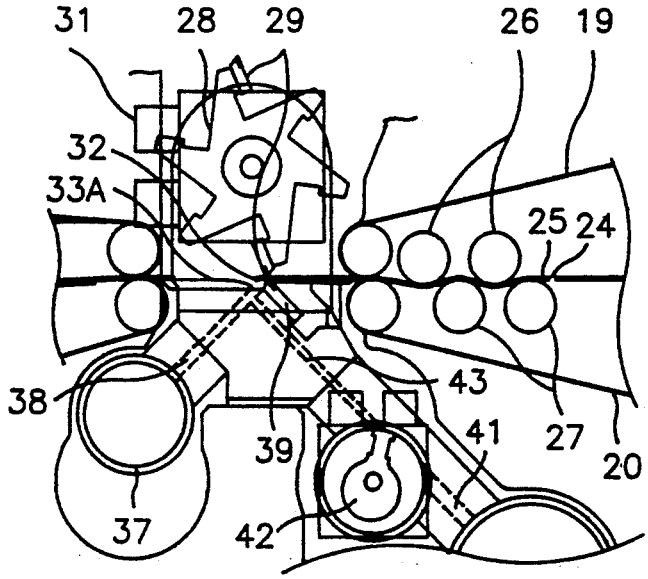
FIG. 3 is a schematic, enlarged side elevation with some parts shown in phantom showing the downstream cutting head in position to cut the leading edge of a sheet or signature with the positive air pressure rotary air valve closed.
Figure 4:
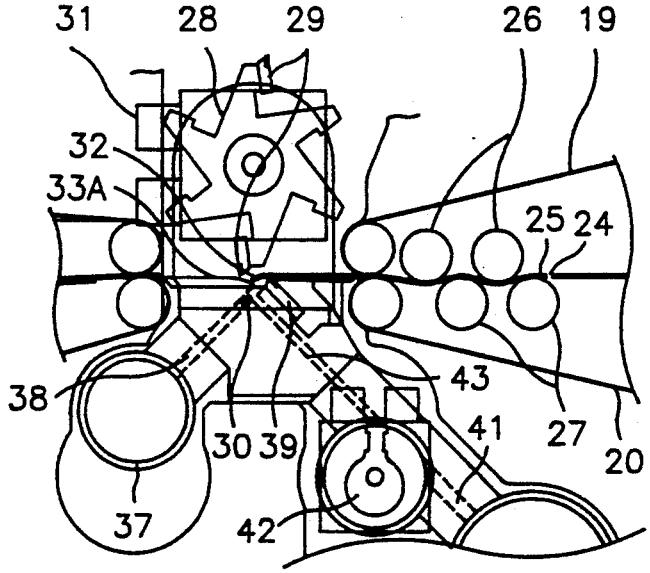
FIG. 4 is similar to FIG. 3 but showing the cutting head advanced and a chip entering the chip removal tube with the positive air pressure rotary air valve still closed.
Figure 5:
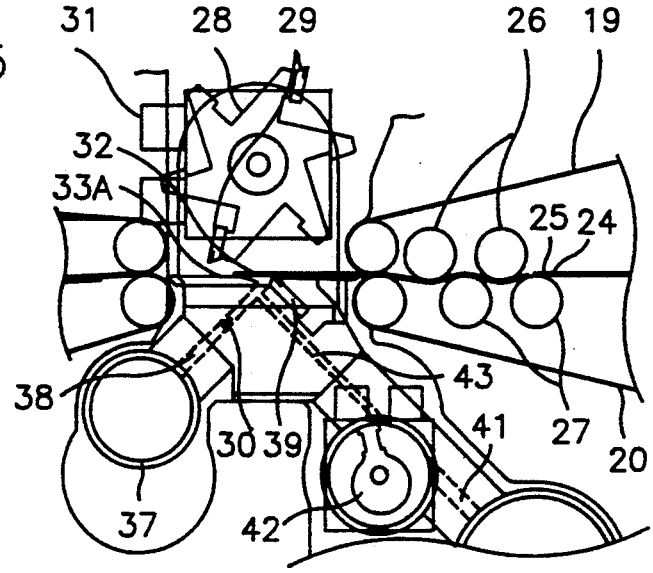
FIG. 5 is similar to FIGS. 3 and 4, but showing the rotary air valve reopened to raise the leading edge of the gap cut sheet or signature so that it continues downstream to the next section of the sheeter.

The cycling of the chip removal system 36 is best illustrated in FIGS. 3–5 of the drawings. As best seen in FIG. 3, the second rotary knife 29 is in position to cut chip 30 from the leading edge of sheet or signature 22 as it is being held firmly by the corrugation rollers 26. Slightly before, during, and slightly after the chip 30 is cut, rotary air valve 42 is closed so that after the vacuum reduces the air pressure in air passages 43, and then draws air through the top end of the transverse slot 38 near the downstream side of the stationary blade 39, the partially cut, then fully cut, chip 30 goes through the transverse slot 38 of the vacuum tube 37.

The leading edge 32 of the finished sheet or signature 33 tends to follow the chip 30 into the transverse slot 38 of vacuum tube 37 if the sheet or signature 33 is of insufficient stiffness to resist. Just as soon as chip 30 is clear of the outer end of transverse slot 38, the rotary air valve 42 starts to open, allowing high pressure air to go through the air passages 43 which communicate with the outer ends of the transverse slot 38. This pulse of air is in part directed outwardly towards the leading edge of the finished sheet or signature 33.

The pressure and the volume of the air are adjusted and times so that most of the air goes to the vacuum tube 37 and a minor part fills the outer end of the transverse slot 38 to slightly pressurize this area behind stationary blade 39. This effectively prevents the leading edge 32 of the sheet or signature 33 from following the chip 30 into the transverse slot 38, and the slight air pressure also supports the leading edge 32 to guide it onto the downstream deck plate 33A, on downstream to the downstream conveyor belt system 34 and to the stacking system 35.

The process is continuously repeated to deliver a steady stream of finished sheets or signatures 33 to the downstream conveyor belt system 34 and to the stacking system 35. The upstream rotary cutting head 16, the rotary air valve 42, and the vacuum to the vacuum tube 37 can be controlled to effectively remove them from the system so that the downstream rotary cutting head 28, second rotary knife 29, and the conveyor belt systems 15 and 34 may function as a conventional sheeter, saving a substantial additional capital investment in such conventional sheeting equipment.

Figure 6:
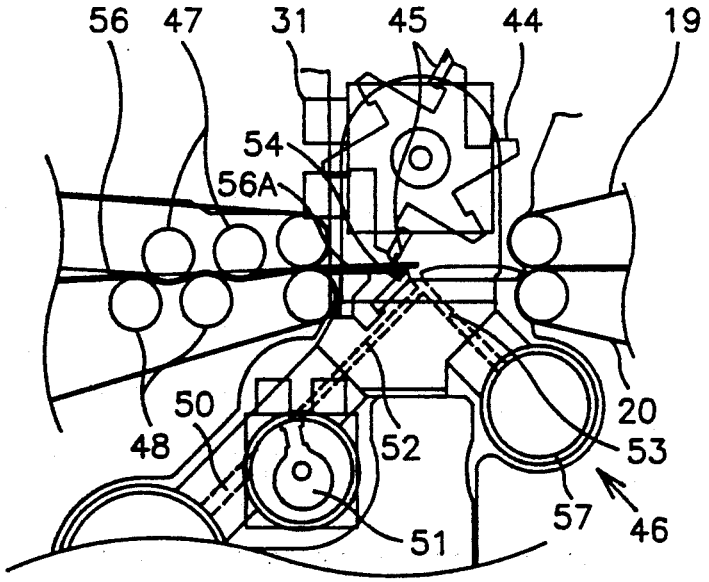
FIG. 6 is similar to FIG. 3, but showing a second embodiment of the invention in which the downstream cutting head rotates in the opposite direction to cut the trailing edge of a sheet or signature which has already passed under the cutting head, and the reversed chip removal system with the rotary air valve closed.
Figure 7:
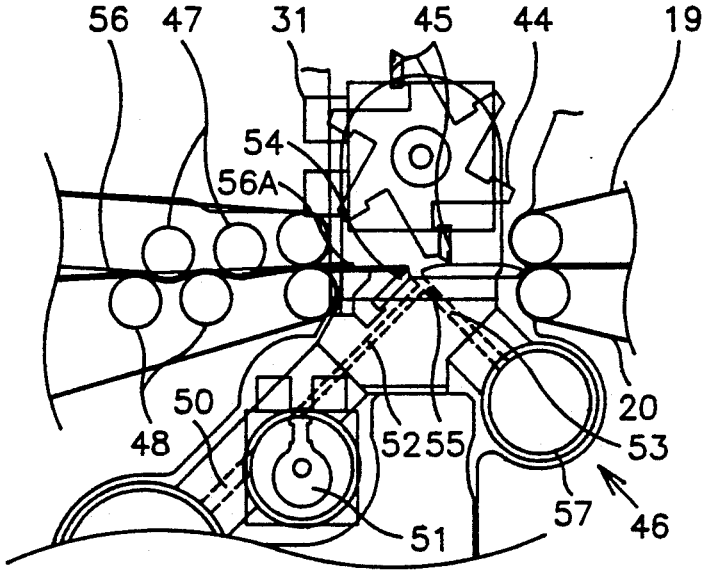
FIG. 7 is similar to FIG. 4, showing the reversed chip removal system pulling away the trailing edge chip while the rotary air valve remains closed.
Figure 8:
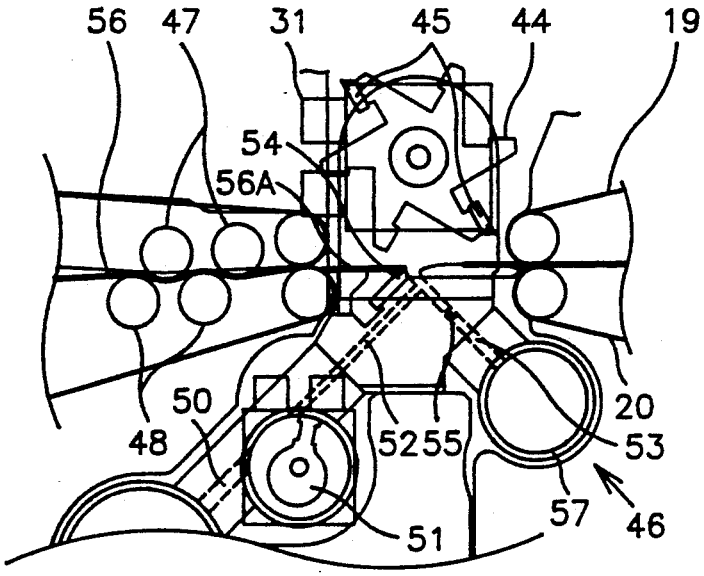
FIG. 8 is similar to FIG. 5, but showing the rotary air valve open to insure the horizontal travel of an incoming sheet or signature over the chip removal system.

In a second embodiment of the invention, a downstream cutting head 44 is provided which rotates counter clockwise as viewed in FIGS. 6–8. It carries a downstream rotary knife 45 which rotates downwardly to cut the trailing edge 25 of a sheet or signature 22.

As can be seen in FIGS. 6–8, the disposition of the parts of the vacuum chip removal system 46 is reversed from that shown in FIGS. 3–5. The components are otherwise similar, and their purposes are the same.

As seen in FIG. 6, corrugating rollers 47 and associated stationary rollers 48 are now disposed downstream from the cutting head 44, because the sheet or signature 22 is cut on the trailing edge 25. The high pressure air system 49 and its associated air passages 50, rotary air valve 51 and second air passages 52 are disposed to the downstream side of the system and the second air passages 52 slant upstream towards the leading edge 32 of an incoming sheet or signature 22. Vacuum tube 53 of vacuum chip removal system 46 angles upwardly and downstream to transverse slot 53 disposed just below stationary knife 54 which cooperates with the downstream rotary knife 45 to cut a chip 55 from the trailing edge 25 of sheet or signature 22 to create a finished sheet or signature 56.

As seen in FIGS. 6–8, the sequence of opening and closing the rotary air valve 51 is coordinated so that chip 55 will be removed quickly down vacuum tube 57 as soon as it is free from the finished sheet or signature 33. FIG. 6 shows the downstream rotary knife 45 just as it contacts the trailing edge 25 of the sheet or signature 22 and the rotary air valve 51 closed to allow full vacuum under the trailing edge 25 being cut into chip 55. FIG. 7 also shows the rotary air valve 51 closed at the instant chip 55 is being removed into transverse slot 53.

As seen in FIG. 8, rotary air valve 51 then opens to allow a pulse of high pressure air to cancel the effect of the vacuum in transverse slot 53 while the next upstream sheet or signature 22 passes over the chip removal transverse slot 53 without being sucked down. The upstream sheet or signature 22 then travels into the corrugating rollers 47 so that its trailing edge 25 may be cut.

Figure 9:
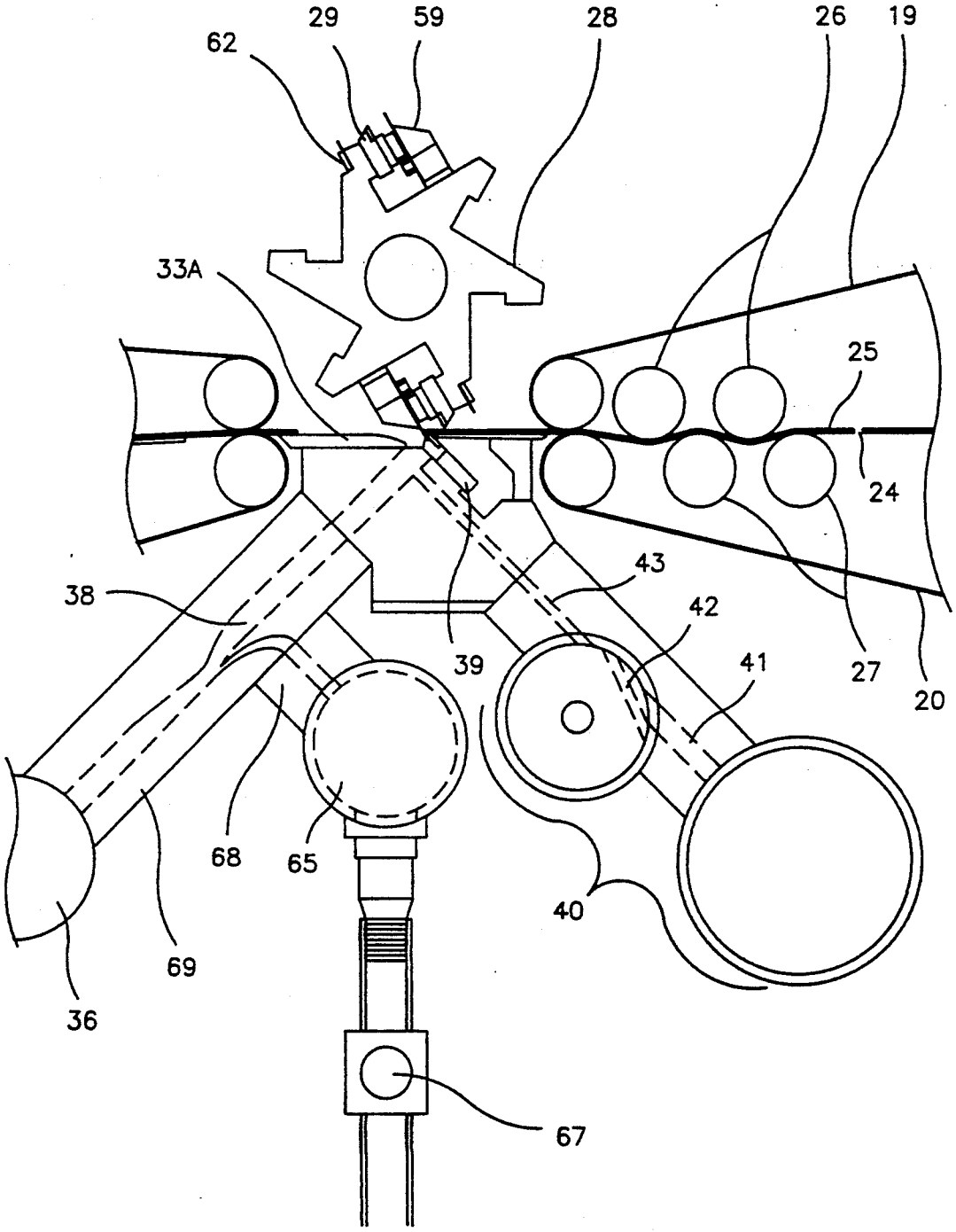
FIG. 9 is a schematic side elevation with some parts shown in phantom showing a modified downstream cutting head having a flipper and a knockdown with the cutting head in position to cut the leading edge of a sheet or signature with the positive air pressure rotary air valve closed.
Figure 14:
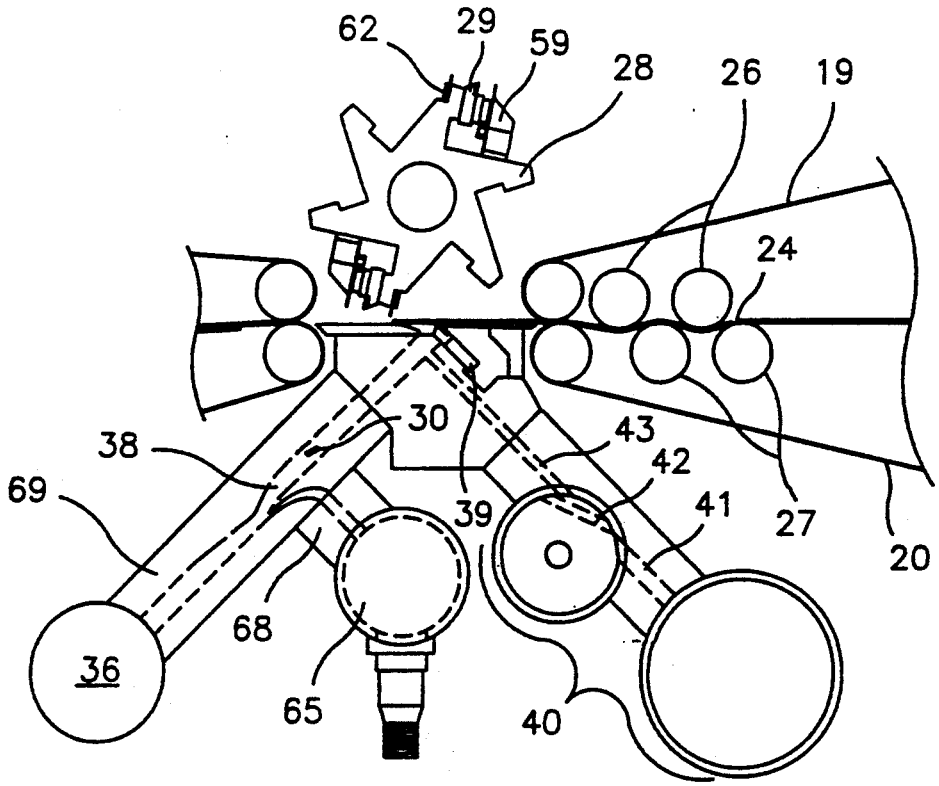
Figure 15:
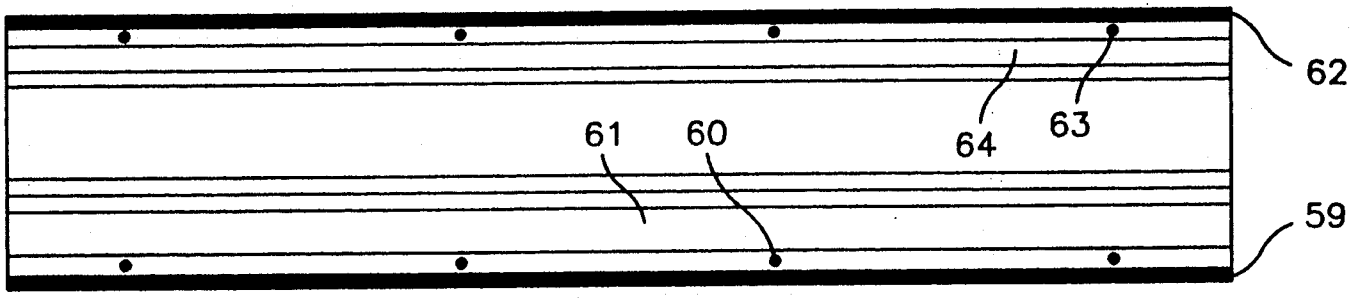
FIG. 15 is front plan view showing the attachment of the flipper and knockdown to the cutting head.

When high speed operation is required, the presently preferred embodiment of the invention is shown in FIGS. 9–16 of the drawings. As seen in FIGS. 9–16, the downstream cutting head 28 is provided with a pair of flippers 59 which are disposed just ahead of the each downstream rotary knife 29. The flippers 59 are made of a resilient, flexible material, such as Delrin plastic, and they are secured to the cutter head 28 by a plurality of countersunk screws 60 which hold a retaining plate 61 firmly against the transverse end surface of the flipper 59 to secure it, and to urge the flipper 59 outwardly on a radial axis from the surface of the cutter head 28, as best seen in FIGS. 9 and 15.

The purpose of the flipper 59 is to contact and push a chip 30 down into the vacuum opening 38 while the leading edge 32 of a finished sheet or signature 33 is passing over the vacuum opening 38 to the deck plate 33A to be engaged by the downstream conveyor belt system 34. The cycle is substantially the same as described above in connection with FIGS. 3–5. It has been discovered through testing that it is highly desirable for high speed, cyclical operation to include the flipper 59 to assist the chip 30 in its initial entry into the transverse slot 38 of the vacuum tube 37 for efficient, high speed chip removal. It is important to propel the chip 30 below the intersection of the second air passages 43 with the transverse slot 38 before the rotary air valve 42 opens to pulse high pressure air out through the air passages 43 against the underside of the leading edge 32 of the finished sheet or signature 33.

Also shown in FIGS. 9–15 is a knockdown 62 which is also disposed on the cutting head 28, but following the second rotary knife 29. The knockdown 62 may also be made from a resilient flexible material, such as Delrin, and it is also secured to the cutter head 28 by a plurality of countersunk screws 63, which hold a retaining plate 64 firmly against the transverse end surface of the knockdown 62 to secure it, and to urge the knockdown 62 outwardly on a radial axis from the cutter head 28, as best seen in FIGS. 9 and 15.

HIGH SPEED OPERATION

Reference should be made to FIGS. 9 to 14 of the drawings for an understanding of how the flipper 59 and the knockdown 62 function to aid high speed operation of the gap cutter with high speed chip removal.

Figure 10:
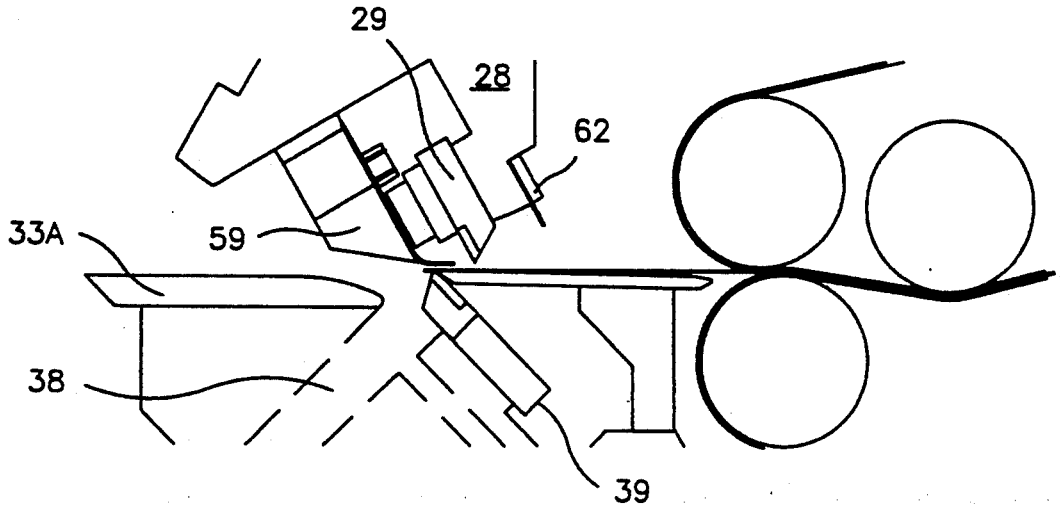
FIG. 10 is similar to FIG. 9, but enlarged, and showing only a portion of the cutting head with the flipper in contact with the leading edge of the incoming sheet or signature.

As seen in FIGS. 9 & 10, as the leading edge of a sheet or signature 22 is being contacted by the flipper 59 and the rotary knife 29, the rotary air valve 42 is in the open position. FIG. 10 is enlarged somewhat from a part of FIG. 9, and it shows the flexible bending action of the flipper 59.

Figure 11:
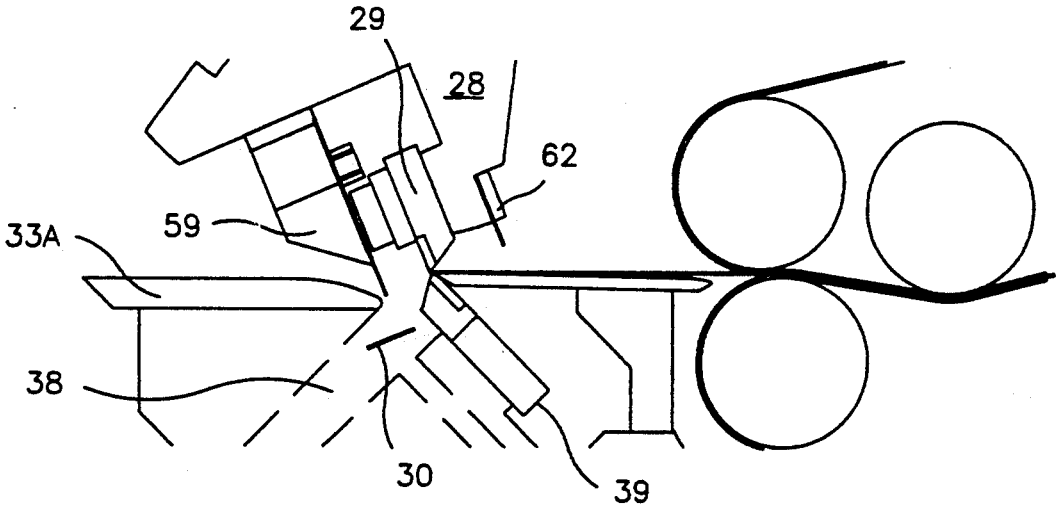
FIG. 11 is similar to FIG. 10, and shows the severed chip after it has been flipped towards the vacuum opening by the flipper.
Figure 12:
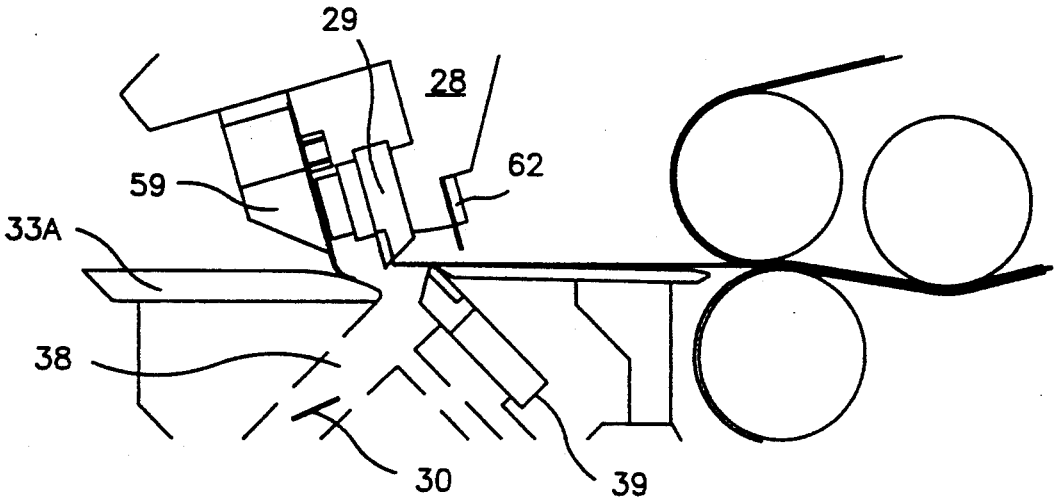
FIG. 12 is similar to FIG. 11, but showing a finished signature bridging the vaccum opening towards the downstream deck plate.
Figure 13:
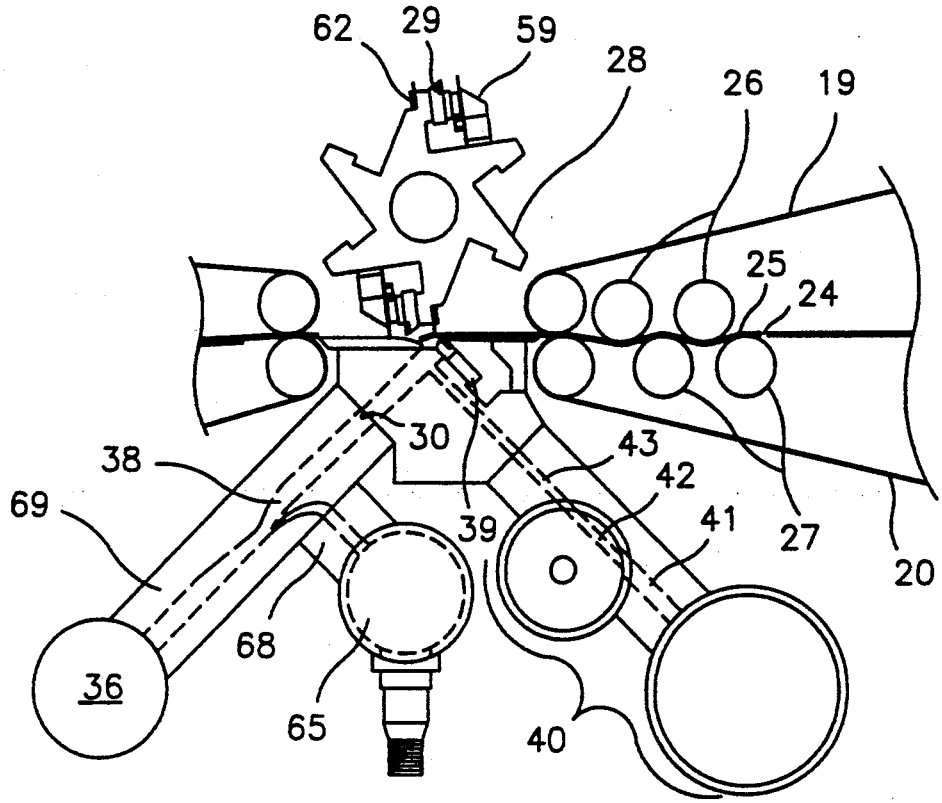
FIG. 13 is similar to FIG. 12, but showing the knockdown in contact with the signature and the signature extended completely across the vacuum opening and in contac with the downstream deck plate.

After the chip 30 has been cut from the leading edge 32 of the sheet or signature 33, the flipper 59 urges the chip 30 down into the transverse slot 38 of vacuum tube 37, as seen in FIG. 11.

After the chip 30 passes the opening of the air passages 43, as shown in FIG. 14, the rotary air valve 42 opens and the chip 30 is accelerated into the slot 38. FIG. 14 shows the chip 30 well down the transverse slot 38. As is also seen in FIG. 14, the knockdown 62 has just completed contact with the leading edge of the cut sheet or signature 33 to press the signature 33 firmly against the downstream deck plate 33A.

The cycle then repeats, and successive sheets or signatures 22 are fed at high speed of about 1,000 to 1,200 feet per minute to the downstream cutter head 28. The rapidly rotating knife 29 cuts the chips 30 from the leading edge 32 of the sheets of signatures 25, and the chips 30 are rapidly removed from the sheet flow path by the above described vacuum system.

Figure 16:
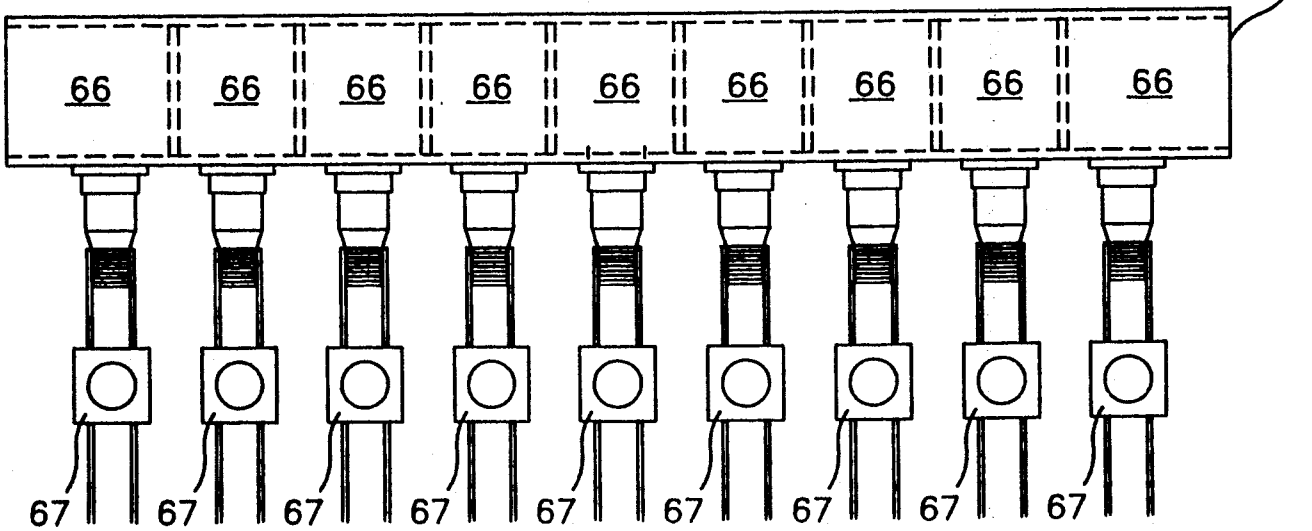
FIG. 16 is a schematic plan view of the nine separate air chambers and their associated air valves, which are disposed transversely across the gap cutter.

Another feature of the modified chip removal system shown in FIGS. 9–16 allows "fine tuning" of the system to avoid clogging of the system when it is operated at very high speeds. A segmented air manifold 65, best seen in FIG. 16, is disposed adjacent and parallel to the transverse slot 38. The air manifold 65 includes nine separate air chambers 66.

Each air chamber 66 is provided with an air regulating valve 67 so that each air chamber 66 can be regulated separately to obtain the optimum pulse of air from air manifold 65 through connecting block 68 into the transverse slot 38 to effectively push successive chips 30 down into venturi assembly 69, and on into the chip removal system 36. Adjustment of the air insures that the successive chips 30 will not hang up in the transverse slot 38 or the venturi assembly 69, thereby causing downtime to clear the chip removal system.

As pointed out above, each of the adjustable parts of the system can be controlled to change the gap for successive short printing runs. Substantially no downtime is required to adjust or change cutting knives. This represents a substantial saving in the highly competitive printing industry. In addition, the upstream cutting head and the chip removal systems can be deactivated so that the apparatus may also be used as a conventional sheeter when gap cutting is not needed. This versatility represents a substantial saving of capital investment for printers whose needs vary from gap cutting of varying sizes to ordinary sheeting operations without gap cutting.

I claim:

1. An in-line, adjustable gap cutting system having a left end and a right end for gap cutting a moving web having a repetitious printed surface comprising:

a first rotary cutting head disposed to rotate towards the web as the web moves toward the cutting head;

a first rotary knife mounted on said first cutting head for cutting the web transversely into sheets or signatures of predetermined lengths in response to a signal determined by the printed surface of the web, said sheets or signatures having transverse leading edges and transverse following edges;

conveyor means having an upstream end receiving the moving web and a downstream end discharging cut sheets or signatures for moving successive sheets or signatures from the cutting head downstream at a controlled rate faster than the speed of the incoming web to generate a predetermined space between the transverse edges of each successive sheet or signature and the incoming web;

gripping means towards the downstream end of said conveyor means gripping successive sheets or signatures leaving the downstream end of said conveyor means;

a second cutting head disposed just downstream from said conveyor means and adjacent the successive incoming sheets or signatures to rotate towards said sheet or signature in a clockwise direction when viewed from the side of the web moving from right to left;

a second rotary knife mounted on said second cutting head for cutting a small chip from the leading edge of successive sheets or signatures, the width of said chip being predetermined in response to a signal determined by the printed surface thereof;

control adjustment means for changing the relative rates of said first and second cutting heads relative to each other, the linear rate of travel of the conveyor means and said gripping means relative to the rotation rates of the cutting heads to control the positions of the transverse cuts in said web and successive sheets or signatures;

a vacuum tube having a vacuum opening disposed below the second rotary knife for removing the small chips as they are being cut to define sheets or signatures; and a positive air pressure means having an opening intersecting the vacuum opening to pulse air against the leading edge of the successive sheets or signatures just after the chip is removed to enable the successive sheets or signatures to move downstream across the vacuum opening without being diverted into the vacuum opening.

2. The gap cutting system of claim 1, in which the vacuum opening of the vacuum tube adjacent the leading edge of the 1 sheet or signature comprises a transverse slot having an outer end, and the opening of the positive air pressure means comprises a plurality of air passages disposed transversely across the outer end of said transverse slot directed toward the leading edge of the successive sheets or signatures to pulse positive air pressure against said successive leading edges just after the successive small chips have been removed.

3. The gap cutting system of claim 2, including a plurality of air pressure regulating valves, each associated with one of said air passages and separately adjustable to obtain the best traverse of the leading edge of the successive sheets or signatures over the vacuum opening.

4. The gap cutting system of claim 3, including a flipper means disposed transversely on the rotary cutter head just ahead of the second rotary knife for contacting the leading edge of the sheet or signature as it is being cut to push the resulting chip into the vacuum opening.

5. The gap cutting system of claim 4, in which the flipper head consists essentially of a stiff, flexible, plastic material which contacts the leading edge of the incoming sheet of signature and pushes the cut chip into the vacuum opening while forming a barrier to prevent the cut leading edge of the sheet or signature from being pulled down into the vacuum opening.

6. The gap cutting system of claim 1, including:

a horizontal deck plate disposed just downstream from the vacuum opening; and a knockdown means disposed transversely on the rotary cutter head just behind the second rotary knife for pushing the leading edge of successive sheets or signatures down against the horizontal deck plate to prevent wrinkling as the finished sheets or signatures travel downstream from the second cutter head.

7. The gap cutting system of claim 6, including a flipper means disposed transversely on the rotary cutter head just ahead of the second rotary knife for contacting the leading edge of the sheet or signature as it is being cut to push the resulting chip into the vacuum opening.

8. The gap cutting system of claim 1, in which the second cutting head is disposed to rotate towards the sheet or signature in a counter-clockwise direction when viewed from the side of the web moving from right to left, and the second rotary knife cuts a chip from the following edge of successive sheets or signatures.

9. The gap cutting system of claim 8, in which the vacuum opening of the vacuum tube disposed below the second cutter head comprises a transverse slot having an outer end, and the opening of the positive air pressure means comprises a plurality of air passages disposed transversely across the outer end of said transverse slot directed toward the leading edge of the successive sheets or signatures to pulse positive air pressure against said successive leading edges just after the successive small chips have been removed.

10. The gap cutting system of claim 8, including a plurality of air pressure regulating valves, each associated with one of said air passages to enable individual adjustment of each air passage to obtain the best traverse of the leading edge of the successive sheets or signatures over the vacuum opening.

11. The gap cutting system of claim 10, in which the means for removing the small chips comprises a vacuum tube having an opening adjacent the trailing edge of the sheet or signature as it is being cut and a positive air pressure means having an opening intersecting the vacuum opening to pulse air against the leading edge of successive printed sheets or signatures resulting from the cutting of said sheets or signatures just after the chip is removed to enable said successive sheets or signatures to move downstream across said vacuum opening without being diverted into the vacuum opening.

12. The gap cutting system of claim 11, in which the opening of the vacuum tube adjacent the trailing edge of the sheet or signature comprises a transverse slot, and the opening of the positive air pressure means comprises a plurality or air passages disposed transversely across the outer end of said transverse slot directed to the leading edge of successive sheets or signatures to pulse positive air pressure against said successive leading edges just after the successive small chips have been removed.

13. The gap cutting system of claim 1, including a second positive air pressure means communicating with the vacuum tube to provide a controlled pulse of positive air pressure against the successive small chips to accelerate chip removal.

14. The gap cutting system of claim 13, in which the second positive air pressure means comprises:

a high pressure air manifold extending transversely just below and parallel to the vacuum opening;

a connecting block communicating between the high pressure air manifold and the vacuum opening; and air flow regulating means to carefully control high pressure air pulses from the high pressure air manifold into the vacuum opening.

15. The gap cutting system of claim 14, in which the high pressure air manifold comprises:

a plurality of air chambers; and a plurality of air regulating means, one each being associated with a corresponding air chamber to provide transverse adjustment of the high pressure air pulses to the vacuum opening for the most effective chip removal.

* * * * *